US007764259B2

(12) United States Patent
Wu et al.

(10) Patent No.: US 7,764,259 B2
(45) Date of Patent: Jul. 27, 2010

(54) WIRE-ON-ARRAY LIQUID CRYSTAL DISPLAY

(75) Inventors: Tsung-Yu Wu, Hsinhua (TW); Ying-Lieh Chen, Hsinhua (TW); Lin-Kai Bu, Hsinhua (TW)

(73) Assignee: Himax Technologies Limited, Sinshih Township (TW)

( * ) Notice: Subject to any disclaimer, the term of this patent is extended or adjusted under 35 U.S.C. 154(b) by 961 days.

(21) Appl. No.: 11/267,289

(22) Filed: Nov. 7, 2005

(65) Prior Publication Data

US 2007/0103422 A1 May 10, 2007

(51) Int. Cl.
*G09G 3/36* (2006.01)

(52) U.S. Cl. ..... 345/98; 345/100

(58) Field of Classification Search ..... 345/87, 345/98–100, 204, 211
See application file for complete search history.

(56) References Cited

U.S. PATENT DOCUMENTS

| | | | | |
|---|---|---|---|---|
| 6,806,861 | B1 * | 10/2004 | Sakaguchi et al. | 345/100 |
| 2001/0013850 | A1 * | 8/2001 | Sakaguchi et al. | 345/87 |
| 2005/0012700 | A1 * | 1/2005 | Hara | 345/89 |
| 2005/0184978 | A1 * | 8/2005 | Bu et al. | 345/204 |

* cited by examiner

*Primary Examiner*—Regina Liang

(57) ABSTRACT

A wire-on-array (WOA) flat panel display is provided. The wire-on-array (WOA) flat panel display is characterized in a plurality of high input impedance components between the flexible printed circuit (FPC) board and the corresponding source driver circuits. Each of the high input impedance components is able to receive gamma voltages with little input current and then transmit the gamma voltages to each of the source driver circuit for production of source voltages of little banding effect.

11 Claims, 2 Drawing Sheets

WIRE-ON-ARRAY LIQUID CRYSTAL DISPLAY

BACKGROUND

1. Field of Invention

The present invention relates to a liquid crystal display (LCD). More particularly, the present invention relates to a wire-on-array (WOA) liquid crystal display (LCD) in which gamma voltages are transmitted to source driver circuits through high-input impedance components.

2. Description of Related Art

With the progress of the flat panel display (FPD), there is a tendency to shift conventional cathode-ray tube (CRT) displays to liquid crystal displays (LCD) due to smaller volume, less weight, lower radiation and lower power consumption. Nowadays, LCD panels have been commercially used in consumer products, such as personal digital assistant (PDA), mobile phone, camera, laptop and television.

FIG. 1 shows a framework diagram of a conventional flat panel display 100, such as an LCD, which comprises a substrate 102, a pixel array 104, a plurality of gate driver circuits (not shown in FIG. 1) and source driver circuits 106, a system circuit 108 and a plurality of flexible printed circuit (FPC) boards 110. Generally speaking, in the fabrication of the flat panel display 100, the pixel array 104 having a plurality of pixel elements arranged in columns and rows are fabricated on the substrate 102 usually made of glass, in which each of the pixel elements is provided to control the quantity of light emission. Each of the pixel elements within the pixel array 104 is controlled by the corresponding gate driver circuit and the corresponding source driver circuit 106.

The gate driver circuits and the source driver circuits 106 are usually fabricated on peripheral areas of the pixel array 104 for providing gate voltages and source voltages to each of the pixel elements within the pixel array 104, with the gate voltages sequentially enabling a row of pixel elements within the pixel array 104 and with the source voltages driving the enabled pixel elements for light emission. In this case, gamma voltages are transmitted from the system circuit 108 through each of the flexible printed circuit (FPC) circuits 110 to the corresponding source driver circuits 106. Then the source driver circuits 106 can produce source voltages with respect to data signals received from each of the flexible printed circuit (FPC) boards 110, and further with respect to the gamma voltages received from each of the flexible printed circuit (FPC) boards 110.

Generally, the source driver circuits 106 may be fabricated directly on the substrate 102 using a conventional process, such as chip-on-glass (COG) process, and the system circuit 108 may be fabricated on a printed circuit board (PCB) separated from the substrate 102. Each of the flexible printed circuit (FPC) boards 110 respectively connects each of the source driver circuits 106 to the system circuit 108 in order to transmit required signals including power, data signals and gamma voltages from the system circuit 108 to each of the source driver circuits 106.

In this case, since the flat panel display 100 has a plurality of flexible printed circuit (FPC) boards 110, the cost of the flat panel display 100 is relatively high. Therefore, another flat panel display 200 with only one flexible printed circuit (FPC) board 210 is highly desired, which is schematically shown in FIG. 2. It can be seen that, in FIG. 2, the flat panel display 200 comprises a substrate 102, a pixel array 104, a plurality of gate driver circuits (not shown in FIG. 2) and source driver circuits 206, a system circuit 208 and only one flexible printed circuit (FPC) boards 110. In this case, the source driver circuits 206 for the pixel array 104 are connected in series, and the system circuit 208 can provide required signals including power, data signals and gamma voltages to one of the source driver circuits, such as the front-end source driver circuit 206, through the flexible printed circuit (FPC) board 210. The required signals then can be transmitted to other source driver circuits in a predefined order. With this, each of the source driver circuits 206 can produce source voltages with respect to the data signals and the gamma voltages received from the preceding source driver circuit or directly received from the flexible printed circuit (FPC) board 210. The required signals communicated between the flexible printed circuit (FPC) board 210 and the front-end source driver circuit and between any source driver circuit and its following source driver circuit can be transmitted on wires directly formed on the substrate 102. With only one flexible printed circuit (FPC) board 210, the cost of the flat panel display 200 can be significantly reduced and the area required for the system circuit 108 can be also reduced.

Some problems, however, occur in the conventional wire-on-array (WOA) display. One of the problems is the degradation of the gamma voltages due to transmission loss between different source driver circuits. Specifically, the degradation of the gamma voltages is likely to make the output source voltages from each of the source driver circuits 206 corrected on different bases, which may lead to a banding effect of the whole display image. Therefore, a wire-on-array (WOA) display panel to overcome the afore-mentioned problem is highly desired.

SUMMARY

It is therefore an objective of the present invention to provide a wire-on-array (WOA) display in order to remove the banding effect of the display image and further in order to achieve a better image quality.

It is another objective of the present invention to provide a wire-on-array display, in which gamma voltages are transmitted to each of the source driver circuits through high input impedance components separated from or built in the original source driver circuits.

To achieve the foregoing and other objectives the present invention provides a wire-on-array (WOA) display. The wire-on-array (WOA) display comprises a substrate, a pixel array formed on the substrate, a plurality of gate driver circuits and source driver circuits arranged on peripheral areas of the pixel array, a system circuit producing required signals including power, data signals and gamma voltages, and a flexible printed circuit (FPC) board directly or indirectly transmitting the required signals to each of the source driver circuits. Further, the wire-on-array (WOA) display also comprises a plurality of high input impedance components receiving the gamma voltages from the flexible printed circuit (FPC) board and transmitting the gamma voltages to each of the source driver circuits with little input current. With this, each of the source driver circuits may produce source voltages in view of the data signals received from the flexible printed circuit (PFC) board or received from the preceding source driver circuit, and further in view of the gamma voltages received from the flexible printed circuit (FPC) board. Because little input current flows through each of the source driver circuits, the received gamma voltages for each of the source driver circuit can be of almost identical levels.

Each of the high input impedance components can be implemented as operational amplifiers, such that the gamma voltages can be transmitted to each of the source driver circuits with little input current. Further, each of the high input impedance components and the corresponding source driver circuit may be integrated in a single chip.

BRIEF DESCRIPTION OF THE DRAWINGS

These and other features, aspects and advantages of the present invention will become better understood with regard to the following description, appended claims and accompanying drawings, where:

DESCRIPTION OF THE PREFERRED EMBODIMENTS

Figure 1:
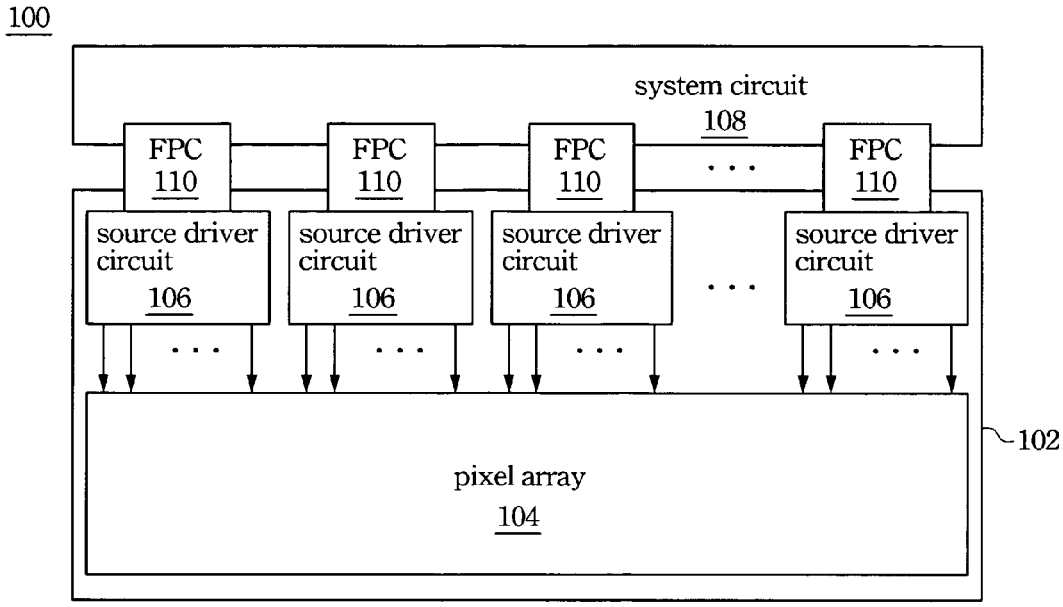
Fig. 1 (PRIOR ART)
FIG. 1 is a diagram of a conventional flat panel display.

Reference will now be made in detail to the preferred embodiments of the present invention, examples of which are illustrated in the accompanying drawings. Wherever possible, the same reference numbers are used in the drawings and the description to refer to the same or like parts.

Figure 2:
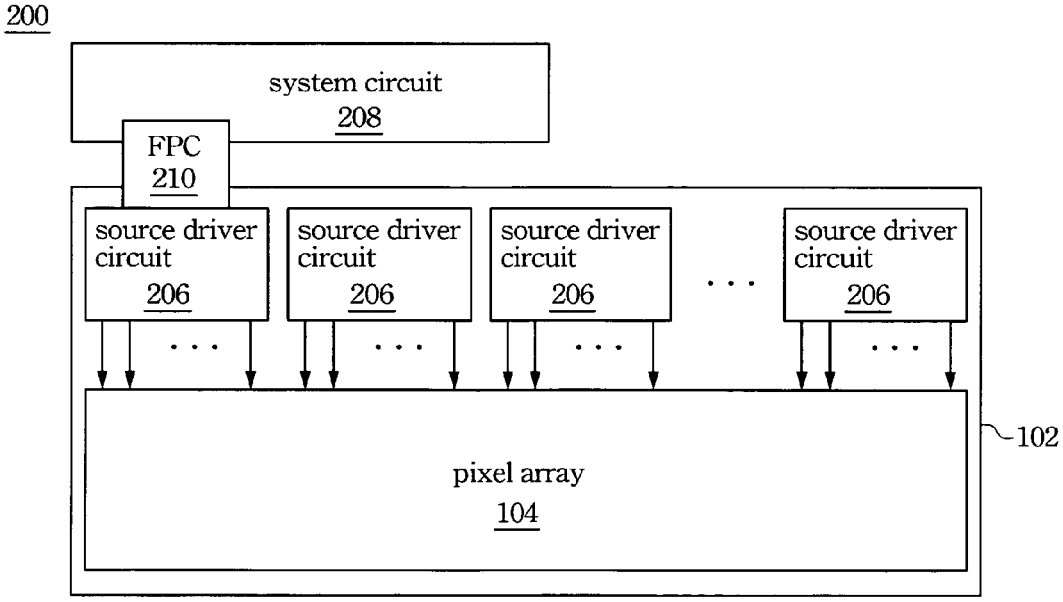
Fig. 2 (PRIOR ART)
FIG. 2 is a diagram of a conventional flat panel display with only one flexible printed circuit (FPC) board.
Figure 3:
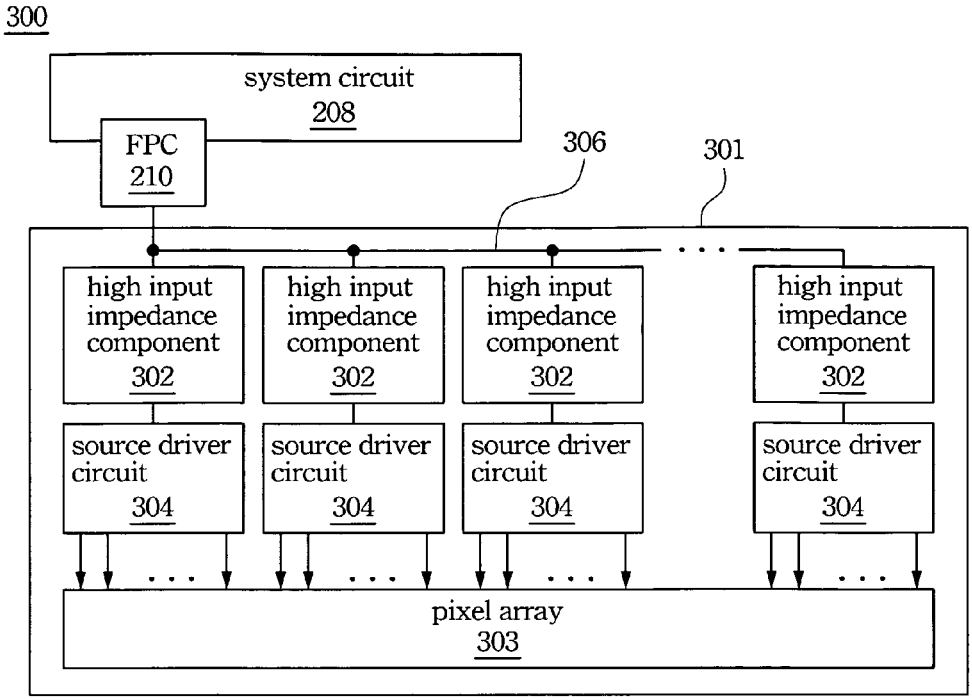
FIG. 3 is a diagram of a wire-on-array (WOA) flat panel display according to an embodiment of the present invention.

FIG. 3 shows a diagram of a wire-on-array (WOA) flat panel display 300 according to an embodiment of the present invention. Similar to the conventional wire-on-array (WOA) flat panel display 200 as shown in FIG. 2, the wire-on-array (WOA) flat panel display 300 comprises a substrate 301, a pixel array 303 formed on the substrate 301, a plurality of gate driver circuits (not shown in FIG. 3) and source driver circuits 304 arranged on peripheral areas of the pixel array 303, a system circuit 208 producing required signals including power, data signals and gamma voltages, and a flexible printed circuit (FPC) board 210 receiving the required signals from the system board 208, and directly or indirectly transmitting the required signals to each of the source driver circuits 304. Similar to the conventional wire-on-array (WOA) flat panel display 200 as shown in FIG. 2, the power and data signals are first transmitted from the system board 208 through the flexible printed circuit (FPC) board 210 to one of the source driver circuits such as the front-end source driver circuit, and then transmitted to other source driver circuits in a predefined order. In addition, the wire-on-array (WOA) flat panel display 300 also includes a plurality of high input impedance components 302 corresponding to each of the source driver circuits 304. Each of the high input impedance components can be implemented as an operational amplifier, which is provided to receive the gamma voltages from the flexible printed circuit (FPC) board 210 and to transmit the received gamma voltages to each of the source driver circuits with little input current. With this, each of the source driver circuits 304 can produce source voltages in view of the data signals received from the flexible printed circuit (FPC) board 210 or the preceding source driver circuit, and further in view of the gamma voltages received from the flexible printed circuit (FPC) board 210.

In this embodiment, since each of the high input impedance components 302 can respectively transmit the gamma voltages with little input current, the degradation of the gamma voltages can be significant reduced. Therefore, each of the source driver circuits 304 can receive the gamma voltages of almost identical levels, so that the output source voltages can be corrected on almost identical bases, and the banding effect of the whole display image can be accordingly removed.

In this case, the wire-on-array (WOA) flat panel display 300 may be an LCD. Further, the system circuit 208 may be fabricated on a printed circuit board (PCB) separated from the substrate 301, and the substrate 301 may be usually made of glass. Further, the communications between the flexible printed circuit (FPC) board 210 and the source driver circuits 304 and between any source driver circuit and its following source driver circuit may be transmitted on wires 306 directly formed on the substrate 301.

In addition, in the fabrication of the wire-on-array (WOA) flat panel display 300, each of the high input impedance components 302 and the corresponding source driver circuit 304 may be directly fabricated on the substrate 301 such as a glass substrate, and each of the high input impedance components 302 and the corresponding source driver circuit 304 may be further integrated into a single chip, possibly the original source driver circuit 304.

Figure 4:
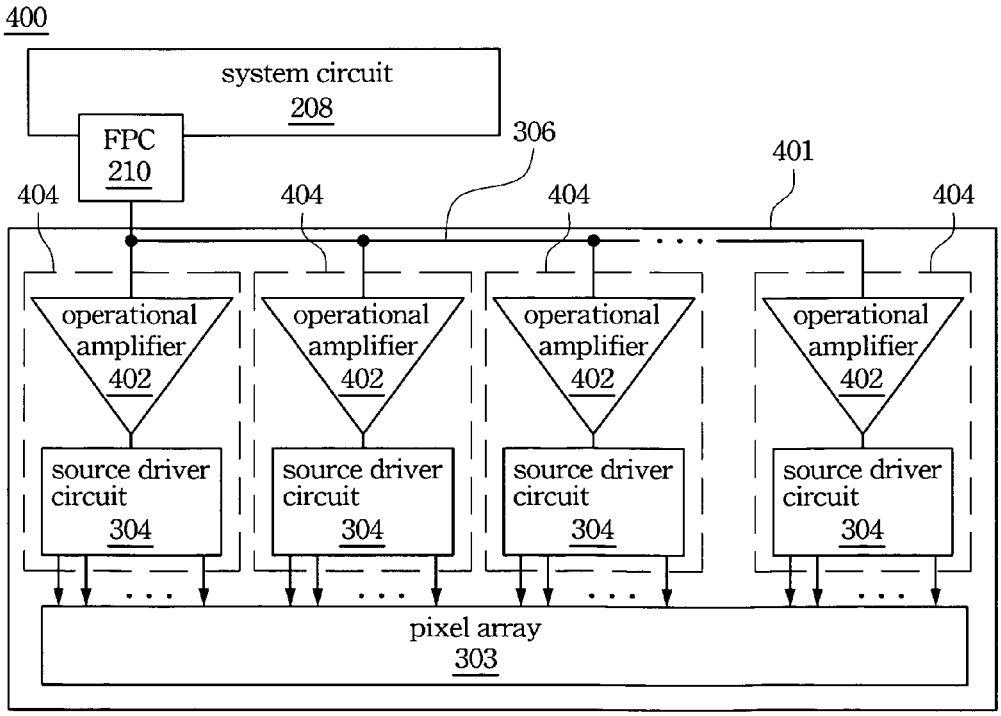
FIG. 4 is a diagram of a wire-on-array (WOA) flat panel display according to another embodiment of the present invention.

Referring to FIG. 4, a diagram of a wire-on-array (WOA) flat panel display 400 according to another embodiment of the present invention is shown, each of the high input impedance components 302 as shown in FIG. 3 may be implemented as an operational amplifier 402 with extremely high input impedance, and each of the operational amplifier 402 and the corresponding source driver circuits 304 may be integrated in a single chip 404, possibly the original source driver circuits 304. With this, each of the operational amplifiers 402 is able to receive the gamma voltages from the system circuit 208 with little input current, and then transmit the received gamma voltages of almost identical levels to each of the source driver circuits 304.

Further, both the high input impedance components 402 and the source driver circuits 304 may be directly fabricated on the substrate, such as a glass substrate, and the system board 208 may be fabricated on a printed circuit board (PCB) separated from the substrate. Further, the communications between the flexible printed circuit (FPC) board 210 and the source driver circuits 304 and between any source driver circuit and its following source driver circuit may be transmitted on wires 306 directly formed on the substrate 401.

According to the foregoing description, a wire-on-array (WOA) flat panel display, such as a wire-on-array (WOA) LCD according to the present invention may provide gamma voltages of almost identical levels for reference to each of the source driver circuits, thus greatly removing the banding effect of the whole display image and achieving a better image quality.

Further, each of the high input impedance components, each of the source driver circuits and the pixel array may be fabricated on the substrate, with each of the source driver circuits and the corresponding high input impedance component fabricate separately or integrally.

Because there is little input current flowing through the high input impedance components, the degradation of the gamma voltages can be greatly removed, thereby each of the source driver circuits can produce source voltages on almost identical bases to produce a display image of invisible banding effect.

Back to FIG. 3, according to an aspect of the present invention, a source driver circuit used in a wire-on-array (WOA) flat panel display is disclosed. The wire-on-array (WOA) flat panel display comprises a substrate 301, a pixel array 303 formed on the substrate, and a system circuit 208 used to provide required signals including data signals and gamma voltage through the flexible printed circuit (FPC) board 210. Moreover, the source driver circuit further comprises a high input impedance component 306 for receiving the gamma voltages from the system circuit 208 through the flexible printed circuit (PFC) board 210, and producing source voltages in view of the data signals and the gamma voltages received from the high input impedance component 302 for driving the pixel array 303. In this case, the high input impedance component is implemented as an operational amplifier, the wire-on-array (WOA) flat panel display is a liquid crystal display (LCD).

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A wire-on-array (WOA) flat panel display, comprising a substrate, a pixel array formed on the substrate, a plurality of gate driver circuits and source driver circuits arranged on peripheral areas of the pixel array, a system circuit producing required signals including gamma voltages, and a flexible printed circuit (FPC) board transmitting the required signals to each of the source driver circuits, characterized in that:

the wire-on-array (WOA) flat panel display further comprises a plurality of operation amplifiers, respectively corresponding to each of the source driver circuit, for transmitting the gamma voltages to the corresponding source driver circuit with little input current, whereby each of the source driver circuits can receive the gamma voltages of substantial identical levels.

2. The wire-on-array (WOA) flat panel display as claimed in claim 1, wherein each of the operation amplifiers is electrically connected between the system circuit and the corresponding source driver circuit.

3. The wire-on-array (WOA) flat panel display as claimed in claim 1, wherein the wire-on-array (WOA) flat panel display is a liquid crystal display (LCD).

4. The wire-on-array (WOA) flat panel display as claimed in claim 1, wherein the wire-on-array (WOA) flat panel display is a liquid crystal display (LCD), and each of the source driver circuits and the corresponding operation amplifier are integrated in pair.

5. The wire-on-array (WOA) flat panel display as claimed in claim 1, wherein the required signals further comprise power and data voltages.

6. A wire-on-array (WOA) flat panel display, comprising:

a substrate;

a pixel array formed on the substrate;

a system circuit used to provide required signals including data signals and gamma voltage;

a plurality of operation amplifiers used to receive the gamma voltages with little input current; and a plurality of source driver circuits, respectively corresponding to the operation amplifiers, used to produce source voltages in view of the data signals received from the system circuit, and further in view of the gamma voltages received from the corresponding operation amplifier, whereby each of the source driver circuits can receive the gamma voltages of substantial identical levels.

7. The wire-on-array (WOA) flat panel display as claimed in claim 6, wherein the system circuit is formed on a printed circuit board (PCB) separated from the substrate, and the data signals and gamma voltage are transmitted to the source driver circuits and the operation amplifiers through a flexible printed circuit (FPC) board.

8. The wire-on-array (WOA) flat panel display as claimed in claim 7, wherein the communications between the system board and the source driver circuits and between any source driver circuit and its following source driver circuit are transmitted on wires directly formed on the substrate.

9. The wire-on-array (WOA) flat panel display as claimed in claim 6, wherein the wire-on-array (WOA) flat panel display is a liquid crystal display (LCD).

10. The wire-on-array (WOA) flat panel display as claimed in claim 6, wherein the wire-on-array (WOA) flat panel display is a liquid crystal display (LCD), and each of the source driver circuits and the corresponding operation amplifier are integrated in pair.

11. The wire-on-array (WOA) flat panel display as claimed in claim 6, wherein the required signals further comprises power.

* * * * *